US005890819A

United States Patent [19]

Compton

[11] Patent Number: 5,890,819

[45] Date of Patent: Apr. 6, 1999

[54] THERMAL PRINTER SYSTEM AND METHOD FOR IMPROVED COMPENSATION OF VARIATIONS IN OPERATING PARAMETERS

[75] Inventor: John Thomas Compton, LeRoy, N.Y.

[73] Assignee: Eastman Kodak Company, Rochester, N.Y.

[21] Appl. No.: 322,971

[22] Filed: Oct. 13, 1994

Related U.S. Application Data

[63] Continuation of Ser. No. 968,952, Oct. 29, 1992, abandoned.

[51] Int. Cl.[6] ..... B41J 2/315

[52] U.S. Cl. ..... 400/120.12; 400/120.11; 400/120.14

[58] Field of Search ..... 400/120.07, 120.12, 400/120.14, 120.1, 120.09, 120.11

[56] References Cited

U.S. PATENT DOCUMENTS

| | | | |
|---|---|---|---|
| 3,934,695 | 1/1976 | Kovalick | 197/1 R |
| 4,113,391 | 9/1978 | Minowa | 400/120 |
| 4,168,421 | 9/1979 | Ito | 219/216 |
| 4,434,354 | 2/1984 | Nakata | 219/216 |
| 4,514,737 | 4/1985 | Suzuki | 346/76 PH |
| 4,573,058 | 2/1986 | Brooks | 346/76 PH |
| 4,684,959 | 8/1987 | Mori et al. | 346/76 PH |
| 4,710,783 | 12/1987 | Caine et al. | 346/76 PH |
| 4,717,924 | 1/1988 | Bangs et al. | 346/76 PH |
| 4,827,279 | 5/1989 | Lubinsky et al. | 346/1.1 |
| 5,087,923 | 2/1992 | Bruck | 346/1.1 |
| 5,109,235 | 4/1992 | Sasaki | 346/76 PH |
| 5,144,336 | 9/1992 | Yeung | 400/120.12 |
| 5,153,605 | 10/1992 | Ohara et al. | 346/76 PH |

FOREIGN PATENT DOCUMENTS

| | | | |
|---|---|---|---|
| A-0 458 507 | 11/1991 | European Pat. Off. . | |
| D-40 03 595 | 8/1991 | Germany . | |
| 62750 | 3/1988 | Japan | 400/120 |

OTHER PUBLICATIONS

*Patent Abstracts of Japan,* vol. 14, No. 140 (M–0950) 1990; & JP–A–02 008 063 (NEC SAN–EI Instr Co. Ltd).

*Patent Abstracts of Japan*, vol. 13, No. 545 (M–902) 1989; & JP–A–01 225 570 (OKI Electric Ind Co. Ltd).

*Primary Examiner*—Edgar Burr
*Assistant Examiner*—Dave A. Ghatt
*Attorney, Agent, or Firm*—Milton S. Sales

[57] ABSTRACT

There is disclosed a thermal printer system in which variations in voltage (and the energy corresponding thereto) supplied to resistance elements of a print head are electronically compensated for. The voltage at the print head is monitored as a line of pixels is being printed pixel by pixel. Units of energy (corresponding to the measured voltage) which have been supplied to the resistance elements are counted, the counts are added together pixel by pixel to obtain cumulative totals and the cumulative totals converted into "compensating" numbers. An image data number for each pixel is compared to the corresponding compensating number, and a respective resistance element is pulsed (energized) a requisite number of times until the image data and compensating numbers match thus achieving a desired level of print density corresponding to the respective image data number. Since the overall print head temperature may change somewhat, depending on the duty cycle of the printing system, these temperature changes also are compensated for in a similar way.

12 Claims, 3 Drawing Sheets

THERMAL PRINTER SYSTEM AND METHOD FOR IMPROVED COMPENSATION OF VARIATIONS IN OPERATING PARAMETERS

This is a Continuation of U.S. application Ser. No. 968,952, filed 29 Oct. 1992 now abandoned.

FIELD OF THE INVENTION

This invention relates to an improved thermal printer system, and method of operation, with accurate yet inexpensive compensation for variations in the energy supplied to and the overall temperature of thermal print elements of the printer.

BACKGROUND OF THE INVENTION

One type of thermal printer used for printing of high quality images employs a thermal head assembly comprising a multitude of closely spaced resistance heating elements. These elements are separately energized in accordance with image data to transfer very small dots of ink or pixels from a thermally reactive dye element onto a print element or page. The image data is in the form of binary words (e.g., 8-bit words) which define each of the positions and densities of the respective pixels and the image thus printed. To produce a high quality printed image with fidelity to an original, the printed pixels should be very small and have a nearly uniform tone scale over a wide range of densities. A thermal print head for such a printer can, by way of example, be a linear, one-dimensional array of thick (or thin) film resistance-heating elements individually formed on a ceramic substrate which is then mounted on a heat sink, such as a metal bar. At present, print heads with 300 miniature resistance elements per lateral inch (2400 elements for an 8 inch wide page) are commonly used. These elements are small enough to give a good degree of visual sharpness. However, minor variations in printing action of these individual resistance elements give rise to visually objectionable non-uniformity (for supposed equal density) in the pixels on a page being printed. This non-uniformity manifests itself in visible lines, streaks and bands in a direction parallel to page motion past the thermal head.

Circuits to compensate electronically for print non-uniformity due to minor differences in the individual resistance elements in a thermal printer have been developed and are currently in use. In U.S. Pat. No. 4,827,279, which is assigned to an assignee in common with the present patent application, there are described a method and apparatus for correcting non-uniformity in the printing action amongst the resistance elements of a thermal print head. In the compensating system disclosed in this patent, correction numbers for each resistance heating element of the head assembly are derived from microdensitometer measurements of a line of print and the correction numbers are then computed according to a specified formula. These correction numbers, which are unique to a particular head assembly, are then entered in a high speed electronic memory circuit of the overall thermal printer apparatus. The numbers so stored are used along with input image print data during subsequent normal operation of the printer to achieve improved quality of printing.

However, in addition to variations in the resistance heating elements themselves, variations in the energy applied to each of them by a power supply in the thermal printer can also cause non-uniformity in printing. The human eye is extremely sensitive to even minor differences in gray scale in a printed image. Thus, relatively small changes in power supply voltage can result in visually objectionable variations in printed image density where supposedly equal density is expected. The current drawn from the power supply in a thermal printer such as described above changes in magnitude by thousands of times between a condition in which only one print element is energized and a condition in which all of the elements are simultaneously energized. It is possible to substantially eliminate changes in power supply voltage under these normal operating conditions of the printer by providing a highly regulated power supply. This approach entails a large and expensive power supply and adds considerably to the size and cost of the overall printer apparatus. Moreover, a regulated supply does not eliminate small voltage variations at the resistance elements themselves due to voltage drops in supply busses from the power supply to the resistance elements. Various attempts have been made in the past to electronically compensate for changes in supply voltage to the resistance elements in a thermal printer. However, these attempts have not been as successful as is desired, or else they were relatively expensive, or both.

It is desirable to provide a highly efficient and accurate system of compensating for supply voltage variations, as well as variations in overall print head temperature, in a thermal printer to achieve substantially uniform print density (where a given density is called for). This system should be fully compatible with existing digital control and head drive circuits (such as described in the above-identified U.S. Pat. No. 4,827,279) and be highly cost effective.

SUMMARY OF THE INVENTION

In accordance with one aspect of the invention, there is provided a thermal printer system in which variations in voltage (and the energy corresponding thereto) supplied to resistance elements of a print head are electronically compensated for. The voltage output of a power supply of the printer is allowed to decrease somewhat as the current drawn from the supply increases from a minimum to a maximum value. Changes in voltage at the print head are monitored as a line of pixels is being printed. A pixel is printed to a desired density, represented by binary image data, by pulsing the respective resistance element of the head a number of times corresponding to the image data count. By way of example, image data for a pixel is represented by 8 binary bits (0 to 255) with maximum print density of that pixel corresponding to 255 uniform energy pulses applied to its corresponding resistance element. As the head supply voltage changes (decreases with increasing load), the number of units of energy which have been supplied to the head elements for a given pulse count are calculated from the measured actual voltage across the head elements, the number of units are added together pulse after pulse to obtain a cumulative number of units of energy so far supplied, and each cumulative total of units is converted into a compensating number with each succeeding pulse. Then the image data number for each pixel is compared to each compensating number to pulse (energize) the respective resistance element a requisite number of times to achieve the desired level of print density corresponding to the respective image data number. Since the overall print head temperature may change somewhat, depending on the duty cycle of the printing system, it is frequently desirable also to compensate for these temperature changes. This is easily accomplished in accordance with the present invention by monitoring the overall print head temperature and by further adjusting the "compensating" numbers obtained as described above and used during the printing of a line of pixels. Thus in this new thermal printing system, even though the voltage of the power supply and the overall print head temperature may vary somewhat during the printing of lines of pixels, the densities of the pixels as printed correspond substantially exactly to given levels of density as called for by the image data.

In accordance with another aspect of the invention, there is provided a thermal printing system which has a print head for printing continuous tone pixels of an image. The print head has a plurality of resistance heating elements adapted to be individually energized with electrical drive pulses, the numbers of electrical drive pulses corresponding to image data. The system also has electrical drive means for energizing the resistance elements with individual electrical drive pulses having a voltage amplitude and a time duration. The system further has compensating logic and data memory circuitry for respectively controlling by successive pulses the drive means in accordance with the image data to print pixels having substantially uniform densities corresponding to the image data. The compensating logic and data memory circuitry determines from a measured voltage amplitude the energy applied to the resistance elements by the successive pulses and applies an adjusted number of pulses to the electrical drive means to apply uniform energy to the resistance elements for given image data such that changes in the amplitude of the voltage of the electrical drive pulses during various conditions of operation of the printing system are compensated for.

In accordance with another aspect of the invention, there is provided a method of operating a thermal printer having a plurality of resistance heating elements which are energized by successive energy pulses to obtain nearly uniform continuous-tone printed pixels during printer operation over a range of conditions in accordance with image data in printing line after line of the pixels. The method includes a step of determining an actual number of energy units applied to the resistance elements by each energy pulse and accumulating the numbers of energy units pulse after pulse; a step of providing compensating numbers corresponding to the cumulative number of energy units; a step of comparing the compensating numbers to the image data; and a step of energizing the respective resistance elements pulse by pulse until the respective compensating numbers and image data match such that the printed pixels correspond in densities substantially equal to the densities called for by the image data.

The invention will be better understood from a consideration of the following detailed description taken in conjunction with the accompanying drawings and claims.

DETAILED DESCRIPTION

Figure 1:
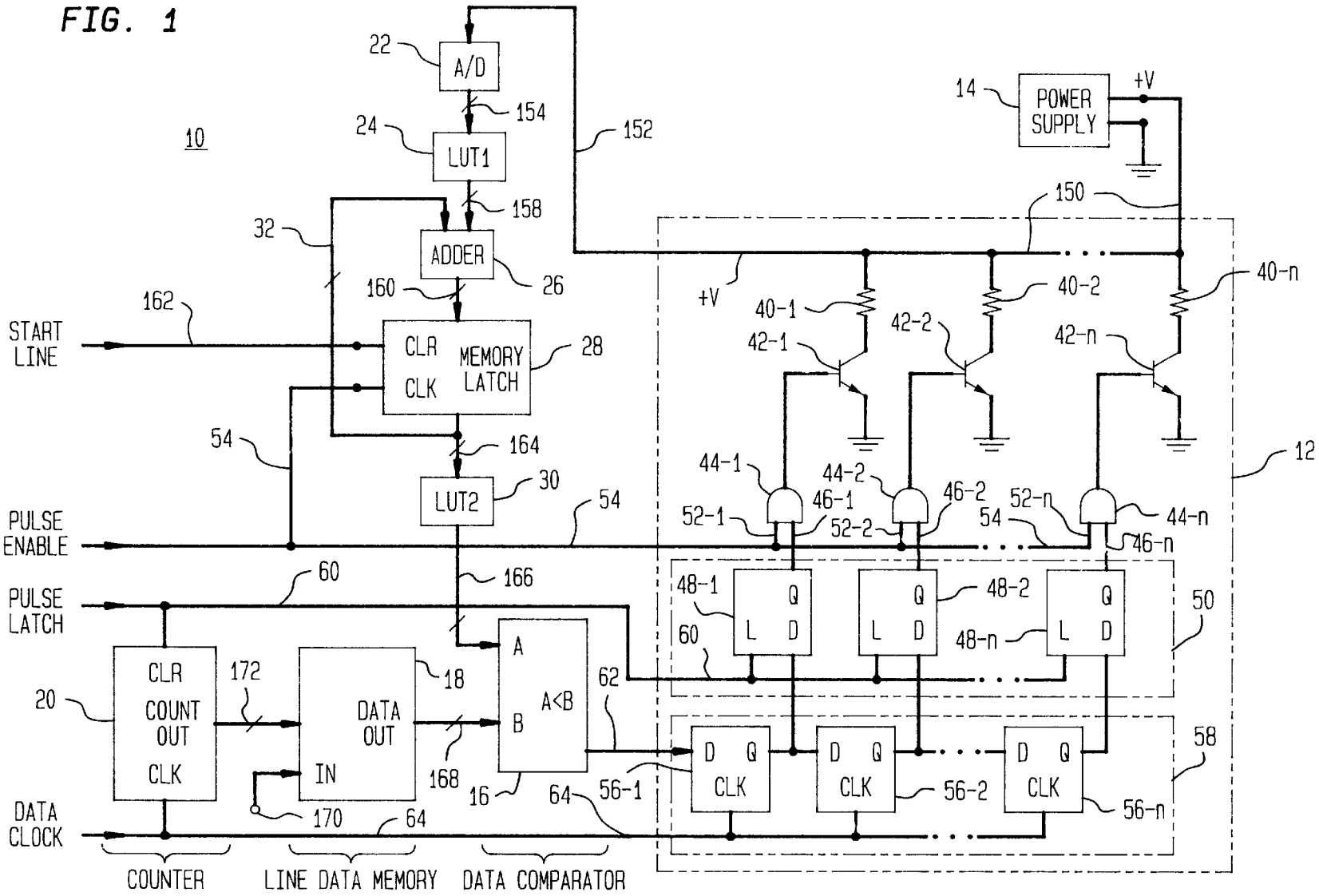
FIG. 1 is a schematic representation of a thermal printing system in accordance with the present invention.

Referring now to FIG. 1, there is shown a schematic representation of a thermal printing system 10 in accordance with the present invention. The system 10 comprises a thermal head and drive circuit assembly 12 (shown within a dashed-line rectangle), a power supply 14, a data comparator 16, a line data memory 18, a counter 20, an analog to digital converter (A/D) 22, a first look-up table (LUT1) 24, an adder 26, a memory latch 28, and a second look-up table (LUT2) 30. A voltage (+V) supplied to the head and drive assembly 12 via a lead 150 by the power supply 14 is monitored via a lead 152 and converted into binary form by the analog to digital converter (A/D) 22 having an output which is applied as a digital number to the first look-up table (LUT1) 24 where voltage values are converted into corresponding energy values. An output of the look-up table (LUT1) 24 is applied to one input of the adder 26, and an output of the adder 26 is applied to the memory latch 28. The output of the memory latch 28 is applied to the second look-up table (LUT2) 30 and by a feedback loop 32 back to a second input of the adder 26. The operation of the printing system 10 will be described in detail hereinafter.

The head and drive assembly 12 comprises a plurality of resistance heating elements 40-l through 40-n, respective drive transistors 42-l through 42-n, AND gates 44-l through 44-n, memory elements 48-l through 48-n of a head drive register 50 (shown within a dashed line rectangle), and memory elements 56-l through 56-n of a line register 58 (shown within a dashed line rectangle). There may, for example, be 2400 heating elements 40-l through 40-n spaced laterally at 300 per inch for a page (not shown) to be printed with an 8 inch wide continuous-tone image. The transistors 42-l through 42-n, which operate as switches (well known in the art), are turned on and off by respective ones of the AND gates 44-l through 44-n. Each of the transistors 42-l through 42-n (shown by way of example as an NPN transistor) has a base connected to a respective output of one of the AND gates 44-l through 44-n. Each transistor 42-l through 42-n has a collector connected to one side of a respective one of the resistance elements 40-l through 40-n, and an emitter connected to ground. The AND gates 44-l through 44-n have respective inputs 46-l to 46-n which are connected to corresponding outputs "Q" of individual memory elements 48-l through 48-n of the head drive register 50. The AND gates 44-l through 44-n also have inputs 52-l through 52-n which are connected in common to a lead 54 to which suitably timed pulses (termed "pulse enable") are applied. This operation will be described in greater detail shortly.

Each memory element 48-l through 48-n of the register 50 has a data input "D" which is connected to a respective output "Q" of corresponding memory elements 56-l through 56-n of the line register 58. Each of the memory elements 48-l through 48-n of the register 50 has an input "L" and all of these inputs L are connected in common to a lead 60 to which suitably timed pulses (termed "pulse latch") are applied. The memory elements 56-l through 56-n of the line register 58 are connected in series, with an output "Q" of one being connected to an input "D" of the next, and so on. The memory element 56-l has its input D connected via a lead 62 to an output of the comparator 16. Each of the memory elements 56-l through 56-n has an input "CLK"; all of these inputs CLK are connected in common to a lead 64 to which suitably timed pulses (termed "data clock") are applied.

A desired sequence of "ones" and "zeros" is serially clocked from the comparator 16 via the lead 62 into the memory element 56-l through 56-n of the line register 58. The respective ones or zeroes in the line register 58, here termed pixel pulses, are shifted by a latch pulse on the lead 60 into the respective ones of the memory elements 48-l through 48-n of the head drive register 50. Thereafter, when an enable pulse is applied to the lead 54, respective ones of the drive transistors 42-l through 42-n are turned on, or left off, in accordance with the pixel print data in the memory elements 48-l through 48-n. The length of time the transistors 42-l through 42-n are "on" is determined by the duration of the enable pulse, which duration is constant for each successive enable pulse and may, for example, be 100 microseconds. There may be 256 such pulses in succession during the printing of a line of pixels. The density of a given pixel printed by any one of the resistance elements 40-l through 40-n is determined by how many times that resistance element is energized with print pulses during the printing of a line of pixels. For example, with 8-bit image data, maximum density of a pixel is obtained by pulsing a given resistance element 255 times, (under the conditions of equal pulse duration and constant supply voltage +V). However, as was explained previously, the load on the power supply 14 represented by the resistance print elements 40-l through 40-n changes greatly (e.g., by a factor of 2400) from the condition when only one resistance element 40 is pulsed to when all of the elements 40 are simultaneously pulsed. In the absence of a high degree of regulation of the power supply 14, the voltage +V applied to the resistance elements 40-l through 40-n changes slightly during normal operation of the printing system 10. These changes in supply voltage are compensated for in a highly accurate and cost effective way by the present invention. Before completing the description of the printing system 10, various conditions of its operation will be explained.

Figure 2:
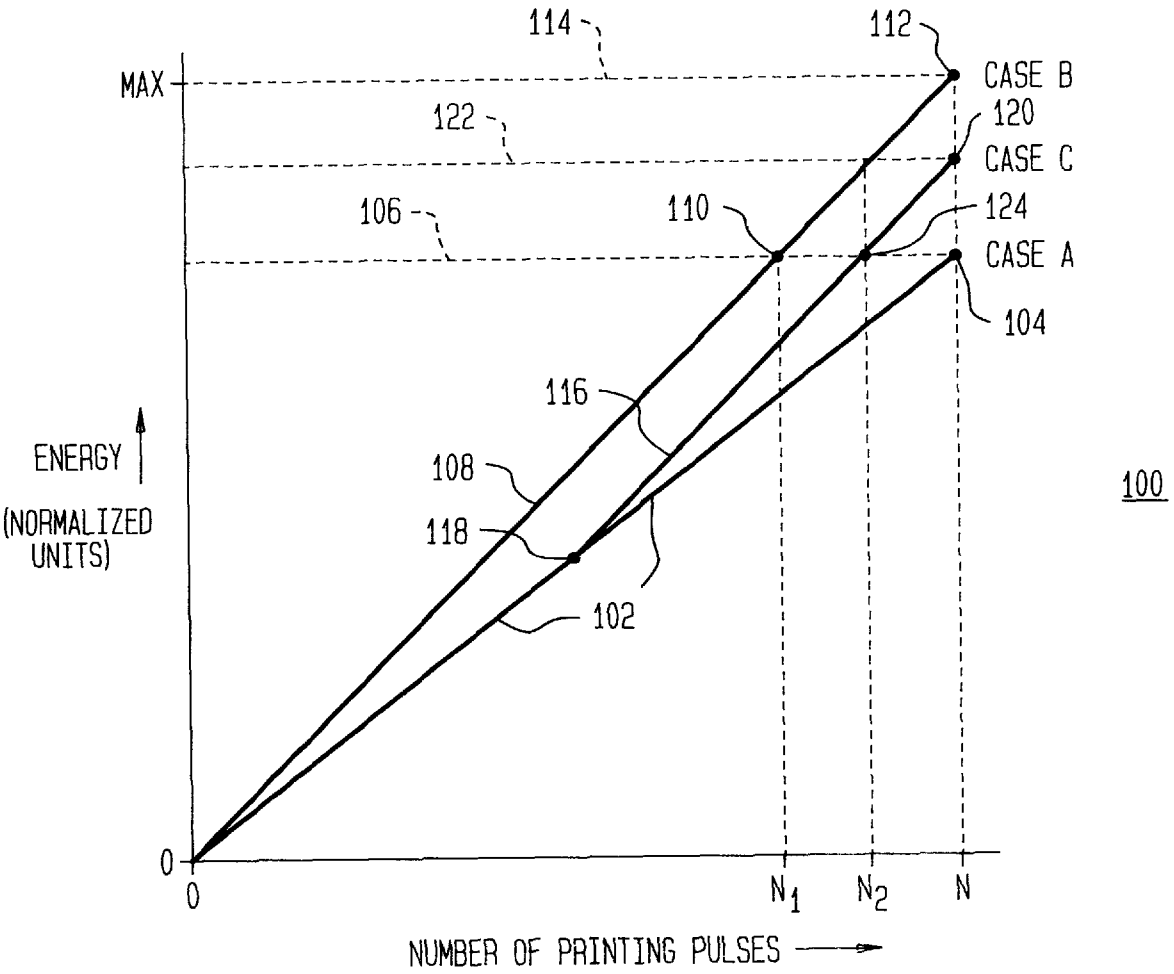
FIG. 2 is a graph illustrating the relation between energy and a number of image pulses for several different conditions of operation of the thermal printing system of FIG. 1.

Referring now to FIG. 2, there is shown a graph 100 illustrating the relation between energy and the number of printing pulses (such as applied to the resistance elements 40-l through 40-n) for several conditions of operation of the printing system 10. The vertical (y) axis of the graph 100 shows cumulative energy (in normalized units) applied by the power supply 14 pulse by pulse to the resistance elements 40-l through 40-n during the printing of a line of pixels. The horizontal (x) axis shows the number of pixel printing pulses (equivalent to units of energy) applied by the transistors 42-l through 42-n to the resistance elements 40-l through 40-n during the printing of a line of pixels.

In a case A, which is indicated by a straight line 102, a condition is illustrated where all of the resistance elements 40-l through 40-n (e.g., 2400 of them) are being energized simultaneously, pulse after pulse. The energy applied to each of the elements 40-l through 40-n (which results in the thermal transfer of dye and the printing of pixels of an image, as explained previously) increases in this illustration linearly pulse by pulse along the line 102 up to a point 104 for a maximum pulse count of "N" (e.g., 255). The cumulative energy level (and hence the level of pixel density) corresponding to the count "N" at the upper end 104 of the line 102 for the condition of Case A (all resistance elements 40 being energized) is indicated by the point of the Y-axis which the horizontal dashed line 106 crosses. On the other hand, where only one of resistance elements 40-l through 40-n e.g., element 40-l, is energized during the printing of a line of pixels (i.e., all but one pixel are "zero" density), the load on the power supply 14 is very much less and accordingly its supply voltage +V is slightly greater. This condition, shown as Case B, is represented on the graph 100 by a straight line 108 which has a steeper slope than the line 102 of Case A. Since the power supply 14 has a much smaller load for Case B than for Case A (and the supply voltage +V varies somewhat with load), the energy level (and corresponding pixel density) indicated by the dashed line 106 is reached at a point 110 on the line 108. This point 110 corresponds to a printing pulse count less than the count "N" and which is here indicated by a different count "$N_1$".

It is to be noted that if the full count "N" were applied for Case B, the energy level at an upper point 112 of the line 108 would have a maximum value "MAX" (indicated by the intersection of horizontal dashed line 114 with the Y-axis). The line 114 lies well above the dashed line 106 and the resulting printed pixel for a count N would have a greater density than for the count $N_1$.

A condition may occur where all of the resistance elements 40-l through 40-n are energized during a first portion of the printing of a line of pixels (i.e., along the lower portion of the line 102), and then only one resistance element 40-l through 40-n is energized during the remainder of printing of that line of pixels (i.e., all pixels but one are printed to partial density, and only one pixel printed to full density). This condition is illustrated as Case C and is here indicated by the lower portion of the line 102 and by a line 116 which begins at a point 118 (where all but one pixel are no longer printed) on the line 102 and then during the printing of the one pixel slopes upward generally parallel to the line 108. The line 116 ends at a point 120 corresponding to the pulse count "N". The energy level at the point 120 is indicated by the intersection of a horizontal dashed line 122 with the Y-axis. The line 116 intersects the dashed line 106 at a point 124 with a corresponding pulse count of "$N_2$". The energy difference between the dashed lines 106 and 114 (and between the dashed lines 106 and 122) would otherwise result in unwanted differences in the full print density of a single pixel illustrated by Case B (or Case C) as compared with the print density of all of the pixels illustrated by Case A.

The present invention simply and effectively eliminates this problem by monitoring the voltage (and corresponding energy) applied to the resistance elements 40-l through 40-n and then applying an "adjusted" number of printing pulses (e.g., corresponding to the numbers N, $N_1$ and $N_2$) to achieve a desired uniform pixel density level (e.g., as represented by the energy level 106). The lines 102 and 108 (Case A and Case B) upwardly diverging from "zero-zero" (the intersections of the horizontal and vertical axis) illustrate the extremes in operating conditions of the printing system 10. The line 116 (Case C) illustrates an intermediate condition It will easily be understood by those skilled in the art from a study of FIG. 2 how "adjusted" printing pulse counts, other than those shown, are obtained in the same way to achieve uniform pixel densities (as called for by any image data). Nearly perfect correspondence between printed pixel density and input image data during continuous variations in the operating conditions of the printing system 10 is obtained by the highly accurate "adjusted" count compensation method and apparatus provided according to the invention.

Referring again to FIG. 1, the voltage +V from the power supply 14 is applied via the lead (power buss) 150 to all of the resistance elements 40-l through 40-n of the thermal head. The lead 152 connected to the buss 150 applies the voltage +V to the input of the A/D converter 22. The A/D converter 22 compares the voltage +V (which may vary as explained previously) to a steady reference voltage (not shown) and then digitizes the difference (if any). The output of the A/D converter 22, by way of example, is an 8-bit number (0 to 255) which is applied in parallel via a multiple connection 154 to the look-up table (LUT1) 24 where a "number" representing voltage is converted into a "number" representing energy. The output of the look-up table 24 (representing energy) is similarly an 8-bit number and is applied in parallel via a multiple connection 158 to one input of the adder 26. The second input of the adder 26 is connected to the feedback loop 32. The output of the adder 26 is an 8-bit number representing cumulative units of energy applied to the resistance elements 40-l through 40-n under various conditions of operation of the printing system 10 such as illustrated by the graph 100 (FIG. 2). The output of the adder 26 is applied via a multiple connection 160 to an input of the memory latch 28. The memory latch 28 has a clock control input (CLK) connected to the lead 54 and a clear control input (CLR) connected to a lead 162. Prior to the beginning of printing of a line of pixels, a start pulse (termed "start line") applied to the lead 162 clears the latch and readies the printing system 10 for the next line printing operation. When an enable pulse is applied to the lead 54, respective ones of the transistors 42-l through 42-n and their resistance elements 40-l through 40-n are turned on (depending on the presence of "ones" in the respective memory elements 48-l through 48-n) as was previously explained. The trailing edge of the enable pulse clocks the data then in the adder 26 into the memory latch 28 via the multiple connection 160. This timing insures that all of the previous pixel print data for a line has been printed by the head and drive assembly 12 before new energy data are clocked into the memory latch 28. The memory latch 28 is connected via a multiple connection 164 to the look-up table (LUT2) 30. This second look-up table 30 converts each input number (representing cumulative energy) then in the memory latch 28 into a "compensating" number which is then applied via a multiple connection 166 to an "A" input of the comparator 16. A "B" input of the comparator 16 is connected via a multiple connection 168 to the data output of the line data memory 18. Image data (e.g., 8-bit data) is serially inputted into respective addresses of the line data memory 18 at a terminal 170 from a source (not shown). The counter 20 has a clock (CLK) input connected to the lead 64. The counter 20 via a multiple connection 172 applies address data to the line data memory 18 and thus controls the output of image data address by address (corresponding to the addresses of the memory elements 56-l through 56-n) from the line data memory 18 to the comparator 16.

By way of example, during operation of the thermal printing system 10, there are 8-bit image data stored in the respective addresses of the line data memory 18. At the beginning of printing of a line of pixels, the image data count stored in the line data memory 18 is presented address by address via the lead 168 to the input B or the comparator 16. Each data count at input B is compared with the "compensating" number count then at the input A of the comparator 16. If the A count is less than the B count, a "one" for a respective address of the memory elements 56-l through 56-n of the line register 58 is inputted to the register 58 via the lead 62. If the B count is equal to or greater than the A count, a "zero" is inputted to the register 58. Thus respective "ones" and "zeroes" for all of the memory elements 56-l through 56-n (e.g., 2400 of them) are loaded into the register 58. These "ones" and "zeroes" are then shifted into the corresponding memory elements 48-l through 48-n of the head register 50, as was previously explained. The next enable pulse applied to the line 54 causes the transistors 42-l through 42-n to energize (or not energize) the resistance elements 40-l through 40-n, respectively, and pulse (or not pulse) them in accordance with the sequence of ones and zeroes in the head register 50. After this first sequence of printing, a next similar sequence is initiated, and so on, up to a total count of 256 (8-bit equivalent) to complete the printing of a line of pixels corresponding to the image data for that line then stored in the line data memory 18. By way of example, if the 8-bit image data stored in the line data memory 18 calls for the printing of all of the pixels to full density (Case A of FIG. 2), the comparator 16 receives step-by-step the image data count at input B and progresses in count number upward from "0" along the line 102 (Case A) until a count of "255" (corresponding to count N and the dashed line energy level 106) is reached. At this point the "compensating" number count at input A of the comparator 16 matches the count at input B and there is no further printing for this line of pixels. If operation of the system 10 is proceeding as in Case B along the line 108 (the printing to maximum density of a single pixel only), the "compensating" number from the look-up table (LUT2) 30 applied to input A of the comparator 16 is adjusted, as was explained previously, to correspond to the count $N_1$, at which point the energy level 106 is attained and printing is ended. And similarly, if operation of the system 10 is in accordance with Case C, the compensating number is adjusted to correspond to the count $N_2$ to obtain the same energy level 106. In this way a uniform energy level (and density level) is obtained for any condition or combination of conditions of operation of the printing system 10.

It will be appreciated that the print compensating circuitry comprising the A/D converter 22, the look-up table 24, the adder 26, the latch 28, and the look-up table 30 with great accuracy and efficiency compensate for variations in the supply voltage +V. These circuit elements may for example, be provided by a single, inexpensive microcontroller such as an Intel No. 8051 and a low cost A/D converter which together cost approximately $5. This is far less expensive than providing for highly regulated voltage from the power supply 14. Moreover, voltage changes which occur directly at the resistance elements 40-l through 40-n themselves are compensated for by the print compensating circuitry provided in accordance with the present invention.

Figure 3:
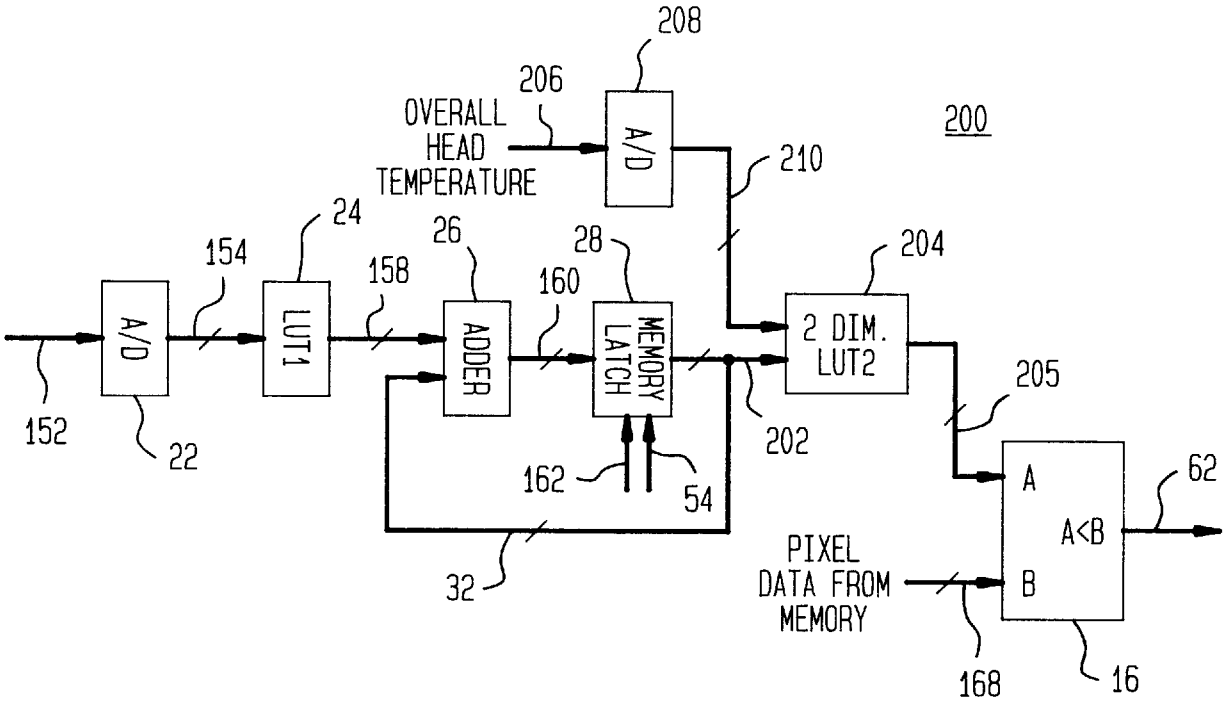
FIG. 3 is a schematic representation of portions of another thermal printing system in accordance with the present invention.

Referring now to FIG. 3, there is shown a portion of a thermal printing system 200 in accordance with the present invention. Portions of the printing system 200 which are not shown are identical to corresponding ones of the printing system 10 of FIG. 1. Certain elements of the system 200 which are shown are also identical to corresponding elements of the system 10 and are given identical reference numbers. As seen here in FIG. 3, the A/D converter 22, the look-up table (LUT1) 24, the adder 26, and the memory latch 28 are connected together and function in the way described previously in system 10 of FIG. 1. The output to the memory latch 28 is applied via a multiple connection 202 to a first input of a two-dimensional look-up table (2 DIM LUT2) 204 whose output is connected via a multiple connection 205 to the A input of the comparator 16 previously described in FIG. 1. A signal representing overall temperature of the printing head (not shown) is applied via a lead 206 to an A/D converter 208 which digitizes the signal and applies the digitized signal via a multiple connection 210 to a second input of the two dimensional look-up table 204. This look-up table 204 is of a type known in the art. It provides an output correction number (similar to the correction number supplied by the look-up table 30) to the multiple connection 205 which provides printing "compensation" in accordance with both the head supply voltage +V applied to the lead 152 and the head temperature signal applied to the lead 206. Changes in the overall temperature of the print head (including mounting substrate and heat sink) before and during a printing operation as well as changes in supply voltage are compensated for in the printing system 200. The operation of the printing system 200 is generally in accordance with the conditions illustrated in FIG. 2 (but with slight changes in the positions of the lines 102, 108 and 116 due to changes in head temperature). The operation of the printing system 200 is otherwise identical to the operation of the printing system 10.

It is to be understood that the embodiments described are illustrative of the general principles of the invention. Modifications may readily be devised by those skilled in the art without departing from the spirit and scope of the invention. For example, data are not limited to 8-bits, nor is the number of resistance heating elements limited to 2400.

What is claimed is:

1. A thermal printing system adapted to compensate for changes in power supply voltage as a function of the number of resistance elements simultaneously energized comprising:

a print head for printing continuous tone pixels of an image, the print head having a plurality of resistance heating elements adapted to be individually energized with successive electrical drive pulses, the numbers of electrical drive pulses corresponding to image data;

electrical drive means comprising a power supply for energizing the resistance elements with individual electrical drive pulses having a voltage amplitude and a time duration, the power supply having a voltage output level which varies as a function of the number of resistance elements simultaneously energized; and compensating logic and data memory circuitry adapted to control the electrical drive means in accordance with the image data to thereby print pixels having substantially uniform densities corresponding to the image data, the compensating logic and data memory circuitry including means for (1) determining, from a measured voltage amplitude, the energy applied to the resistance elements by the successive drive pulses and (2) adjusting the number of electrical drive pulses in response to the measured voltage amplitude to compensate for changes in the number of resistance elements simultaneously energized so that the electrical drive means applies uniform energy to the resistance elements for given input image data regardless of the number of resistance elements energized such that changes in the amplitude of the voltage of the electrical drive pulses during operation of the printing system are compensated for.

2. The thermal printing system of claim 1 wherein:

the power supply supplies a voltage to the resistance elements for the print head; and the compensating logic and data memory circuitry comprises means for monitoring changes in voltage supplied to the resistance elements and means for adding up corresponding amounts of energy of the electrical drive pulses applied to the resistance elements to obtain the adjusted numbers of electrical drive pulses.

3. The thermal printing system of claim 1 wherein the compensating logic and data memory circuitry further comprises temperature data means for monitoring the overall temperature of the print head and for adjusting the adjusted numbers of electrical drive pulses to achieve additional compensation for uniformity in printed pixel densities.

4. The thermal printing system of claim 1 wherein the compensating logic and data memory circuitry comprises comparator means for comparing image data number by number with the adjusted numbers.

5. A thermal printing system adapted to compensate for changes in power supply voltage as a function of the number of resistance elements simultaneously energized to obtain more nearly uniform densities of continuous-tone printed pixels corresponding substantially exactly to image data, the system comprising:

a plurality of resistance heating elements in a print head for printing an image by thermal dye transfer of continuous-tone pixels of ink;

a power supply having a voltage output level which varies as a function of the number of resistance elements simultaneously energized for supplying voltage during successive energizing pulses to the resistance element;

a plurality of switch elements for connecting during successive energizing pulses respective ones of the resistance elements to the power supply voltage to print pixels of ink having continuous-tone density corresponding to image data;

means for receiving and storing image data to be printed as pixels of corresponding tone density;

means for measuring the voltage supplied to the resistance elements to determine the number of units of energy supplied to the resistance elements and for accumulating the numbers of units of energy;

means for determining from the accumulated numbers of units of energy adjusted numbers for energy pulses applied to the resistance elements; and means for comparing the energy adjusted numbers with the image data pixel by pixel and for turning on with successive drive pulses the respective switch elements until respective adjusted numbers and image data match such that variations in the supply voltage as a function of the number of resistance elements simultaneously energized are compensated for regardless of the number of resistance elements energized and unwanted variations in pixel density are reduced.

6. The thermal printing system of claim 5 in further combination with means for measuring overall print head temperature and for further adjusting the energy adjusted numbers to also compensate for changes in head temperature.

7. The thermal printing system of claim 5 wherein the means for measuring and the means for determining comprise a microcontroller in combination with an analog to digital converter.

8. The thermal printing system of claim 7 wherein the microcontroller includes a first look-up table for converting voltage to energy, and a second look-up table for converting cumulative units of energy into the adjusted number counts.

9. A thermal printing system adapted to compensate for changes in power supply voltage as a function of the number of resistance elements simultaneously energized comprising:

a print head for printing continuous tone pixels of an image, the print head having a plurality of resistance heating elements adapted to be individually energized with successive electrical drive pulses, the numbers of electrical drive pulses corresponding to image data;

electrical drive means comprising a power supply for supplying a voltage to the resistance elements to energize the resistance elements with individual electrical drive pulses having a voltage amplitude and a time duration, the power supply having a voltage output level which varies as a function of the number of resistance elements simultaneously energized; and compensating logic and data memory circuitry for respectively controlling the electrical drive means in accordance with the image data to print pixels having substantially uniform densities corresponding to the image data, the compensating logic and data memory circuitry determining from a measured voltage amplitude the energy applied to the resistance elements by the successive drive pulses and applying an adjusted number of electrical drive pulses to compensate for changes in power supply voltage as a function of the number of resistance elements simultaneously energized so that the electrical drive means applies uniform energy to the resistance elements for given input image data regardless of the number of resistance elements energized such that changes in the amplitude of the voltage of the electrical drive pulses during operation of the printing system are compensated for, the compensating logic and data memory circuitry comprising means for monitoring changes in voltage supplied to the resistance elements and means for adding up corresponding amounts of energy of the electrical drive pulses applied to the resistance elements to obtain the adjusted number of electrical drive pulses, the compensating logic and data memory circuitry having an analog to digital converter, a first look-up table, an adder, a memory latch, a feedback loop coupled between the memory latch and the adder, a second look-up table, and a comparator, the analog to digital converter being adapted to receive a signal corresponding to the voltage supplied to the resistance elements and to apply a digital signal generated at an output thereof to the first look-up table, the first look-up table having an output coupled to an input of the adder, the adder, the memory latch, and the feedback loop providing number counts of the energy accumulated during the printing of pixels line by line, the memory latch having an output coupled to an input of the second look-up table, and the second look-up table being adapted to convert the energy counts from the memory latch into adjusted number counts, an output of the second look-up table being coupled to an input of the comparator such that adjusted number counts applied to the comparator compensate for the actual number of electrical pulses applied to the resistance elements in accordance with image data.

10. A method of operating a thermal printer adapted to compensate for changes in a power supply having a power supply voltage which varies as a function of the number of resistance elements simultaneously energized, the printer having a plurality of resistance heating elements which are energized by successive energy pulses to obtain nearly uniform continuous-tone printed pixels during printer operation over a range of conditions in accordance with-image data in printing line after line of the pixels, the method comprising the steps of:

determining an actual number of units of energy applied to the resistance elements by each energy pulse and accumulating the numbers of energy units pulse after pulse;

providing compensating numbers corresponding to the cumulative numbers of energy units;

comparing the compensating numbers to the image data; and energizing the respective resistance elements pulse by pulse until the respective compensating numbers and image data match such that the printed pixels correspond in densities substantially equal to the densities called for by the image data.

11. The method of claim 10 further comprising the steps of:

determining the overall temperature of the resistance elements; and adjusting the compensating numbers provided also to compensate also for temperature variances.

12. A method of operating a thermal printer adapted to compensate for changes in a power supply having a power supply voltage which varies as a function of the number of resistance elements simultaneously energized, the printer having a plurality of resistance heating elements which are energized by successive energy pulses to obtain more nearly uniform continuous-tone printed pixels during printer operation over a range of conditions in accordance with image data in printing line after line of the pixels, the method comprising the steps of:

measuring the voltage and overall temperature of the resistance elements during operation of the thermal printer;

determining from the voltage and temperature the number of units of energy applied to the resistance elements;

accumulating the numbers of units of energy pulse after pulse;

providing compensating numbers corresponding to the cumulative energy numbers;

comparing the compensating numbers to the image data; and energizing the respective resistance elements pulse by pulse until the respective compensating numbers and the image data match such that the printed pixels correspond in densities more nearly equal to the densities called for by the image data.

* * * * *